US005409355A

United States Patent [19]

Brooke

[11] Patent Number: 5,409,355

[45] Date of Patent: Apr. 25, 1995

[54] DIAPHRAGM PUMP

[76] Inventor: Gerard Brooke, The Bannut Tree, New Inn Lane, Avening, Gloucestershire GL8 8NB, England

[21] Appl. No.: 185,831

[22] PCT Filed: Jul. 21, 1992

[86] PCT No.: PCT/GB92/01387

§ 371 Date: Jan. 24, 1994

§ 102(e) Date: Jan. 24, 1994

[87] PCT Pub. No.: WO93/03280

PCT Pub. Date: Feb. 18, 1993

[30] Foreign Application Priority Data

Jul. 26, 1991 [GB] United Kingdom ..... 9116225

[51] Int. Cl.[6] ..... F04B 43/06; F04B 9/12; F01L 21/02

[52] U.S. Cl. ..... 417/395

[58] Field of Search ..... 417/395, 386

[56] References Cited

U.S. PATENT DOCUMENTS 3,429,274 2/1969 Nilsson ..... 417/395
4,662,829 5/1987 Nehring ..... 417/395
4,687,423 8/1987 Maget et al. ..... 417/395 X

FOREIGN PATENT DOCUMENTS 2248425 10/1974 France .
2292184 11/1974 France .
9100417 1/1991 WIPO .

*Primary Examiner*—Richard E. Gluck
*Attorney, Agent, or Firm*—Jones, Tullar & Cooper

[57] ABSTRACT

A pump comprises a flexible diaphragm (10) separating a pumping chamber (12) for the fluid to be pumped from a driving chamber (14) for a pressure fluid operating the pump. An outlet (24) for the pressure fluid from the driving chamber is controlled by a valve element (28) that is molded integrally with the diaphragm and with a tension element (36) that draws the valve element to its closing position. Deflection of the diaphragm by the pressure fluid pumps fluid from the pumping chamber and as the deflection increases the valved outlet of the driving chamber is opened against the force of the tension element. Release of the pressure in the driving chamber allows the valve to close again and the tension element ensures that it returns to a position sealing the driving chamber outlet.

23 Claims, 1 Drawing Sheet

DIAPHRAGM PUMP

This invention relates to diaphragm pumps operated by fluid pressure.

Examples of such diaphragm pumps are described in WO91/00417. For reasons of cost and facility of production, it is desirable to reduce the number of components required to assemble a pump. There may be particular advantages in this for pumps intended to be used in clean or sterile conditions, such as pumps used in medical and surgical procedures. In the said WO91/00147 one example of construction has an integrally formed diaphragm and gas outlet valve closure element interconnected by a collapsible stem, which can all be formed in a single moulding, but it is not simple to ensure that the resilient mounting that holds the closure element can close the valve reliably.

According to the present invention, there is provided a pressure-operated pump comprising a pumping chamber for the fluid to be pumped and a fluid pressure driving chamber having a valve-controlled outlet, a flexible diaphragm between said chambers and being displaceable by pressure in the driving chamber to expel fluid from the pumping chamber, said diaphragm being connected to a resiliently deformable member that includes a valve closure element for said driving chamber outlet and to an extensible tension element that urges the closure element to its operative closing position.

It is found that the provision of the tension element can give a more assured closure. In addition, it is possible to form the diaphragm, closure element and tension element as a single integral member. In contrast to the known pump described above, the connection between the diaphragm and the valve closure element need not apply a closing force to the valve closure element and it can be arranged to operate in a non-collapsible manner.

For efficiency of operation, it is desirable to arrange that the driving chamber outlet valve opens relatively quickly, preferably with a snap-action. For this purpose, the member is so formed that it is resiliently deformed during the pumping stroke, while the valve remains closed, the release of energy of deformation aiding the opening of the valve. For instance, a stem portion of the member connecting the diaphragm to the valve closure element can be arranged to be increasingly tensioned during the pumping stroke to urge the closure element away from the outlet while a pressure differential acts on the element restraining the opening of the valve. When said tension force is sufficient to displace the closure element and allow the countervailing pressure differential to drop, the stored tensile energy opens the valve the faster. Additionally or alternatively, resilient flexure of the valve closure itself can similarly store energy which is released to accelerate the opening movement of the valve.

It may be noted here that in the form of pump described above from WO91/00417, such snap-action does not occur because there is no release of stored energy at the instant of valve opening.

Preferably, the tension that holds the valve closed during a return stroke of the diaphragm is exerted by an element of said member acting as a weak spring having a relatively low rate as compared with the spring rate of the element or elements providing said stored energy. This is desirable in order to minimise the opposing force to said snap-action opening.

By way of example, the invention will be described in one particular form with reference to the accompanying diagrammatic drawings in which.

Figure 1:
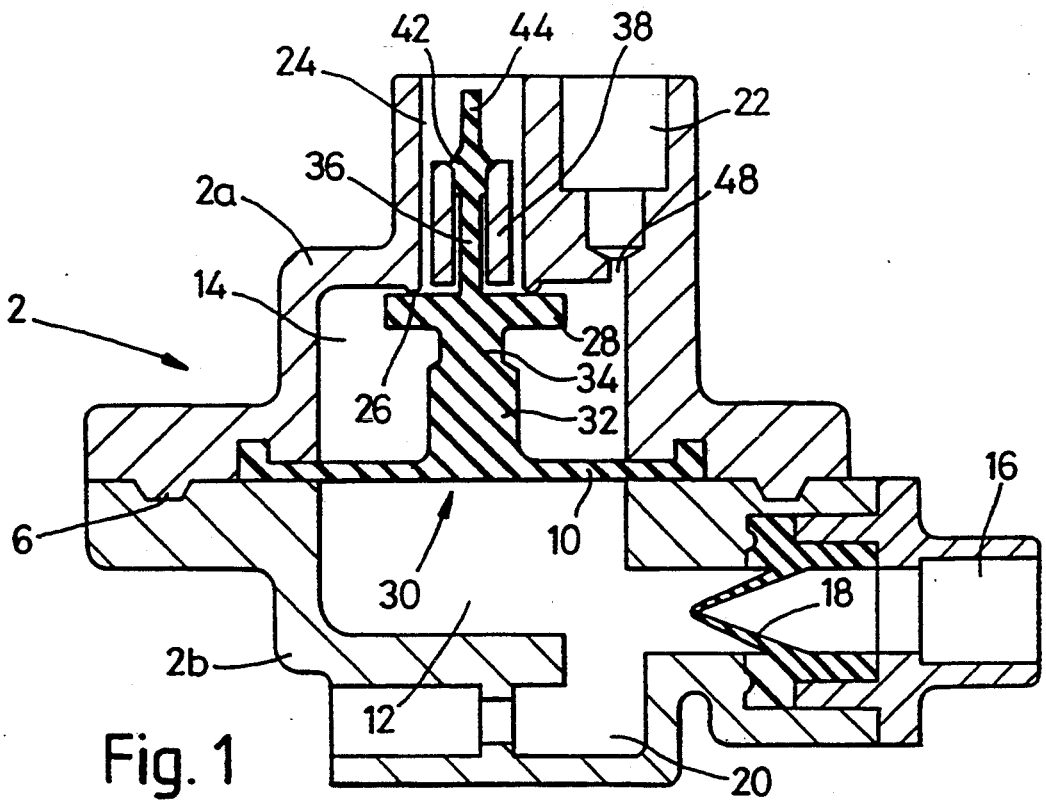
FIG. 1 is an axial section through a pump according to the invention.
Figure 2:
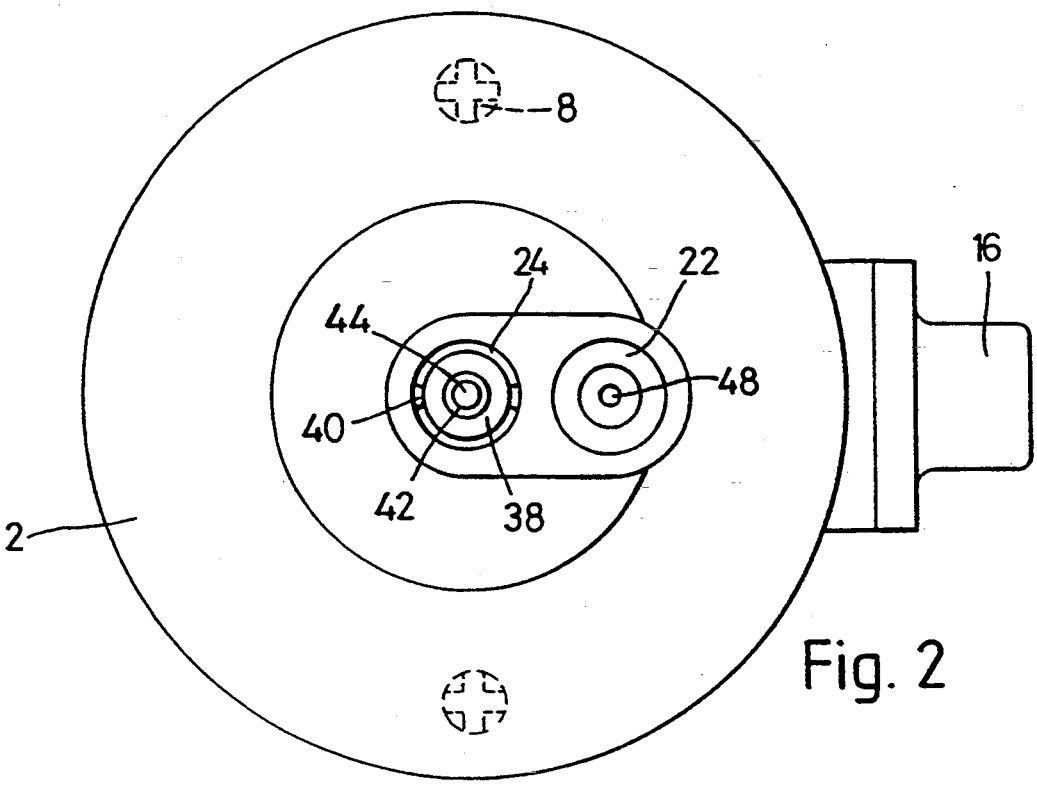
FIG. 2 is a plan view of the pump in FIG. 1.

The illustrated pump comprises a two-part casing 2 comprising upper and lower parts *2a,2b* coaxially located by an integral circumferential rib and groove 6 and angularly located by integral spigot and bore connections 8. A diaphragm 10 is engaged sealingly between the two parts which are solvent-bonded together. The diaphragm divides the interior of the casing into a pumping chamber 12 and a driving chamber 14. Liquid to be pumped fills the pumping chamber 12 through an inlet 16 provided with a non-return valve 18 comprising a pair of flexible lips, normally closed together as shown but flexed apart by an inlet pressure greater than the pressure in the chamber 12. The liquid exits the chamber 12 through an outlet 20 which may also be provided with a non-return valve (not shown) preventing back flow.

The pump is driven by a pressure gas source (not shown) which supplies gas under pressure continuously through an inlet 22 to the driving chamber. An outlet passage 24 is provided for gas exiting the chamber 14 but the passage is normally sealed by a valve comprising a seating 26 which is sealed by a closure element 28. The connecting conduits to the inlets and outlets 16,20,22,24 may be solvent bonded in place if the pump is to be used in sterile conditions, but other known forms of connection can of course be provided.

The diaphragm 10 and the valve closure element 28 form integral parts of a rotationally symmetrical member 30 moulded from resiliently flexible material such as natural rubber. The diaphragm is connected to the closure element by a stem 32 of the member 30 which in this example has a smaller diameter necked portion 34 immediately adjacent the closure element. The resiliently deformable member 30 also includes an integral tail 36 extending from the closure element and through a collar 38 fixed coaxially within the outlet passage 24 by lugs 40. The tail 36 has a relatively small cross-section compared with the stem and neck but incorporates an enlarged portion 42 intermediate its length having a significantly larger cross-section than the internal diameter of the collar through which it passes. The upper end 44 of the tail serves as a guide to thread it into the collar and to pull the enlarged portion 42 through. The tapered top face of the enlarged portion 42 assists its passage through the collar on top of which it is locked in place against the tensions applied to the tail in use. The tail 36 is so formed that in the rest position of the member 30 it is held slightly extended by the engagement the portion 42 with the collar 38, in order to retain the closure element 28 against the valve seating 26. Also, although not visible in the drawings in the rest position there is some tension in the stem 32 flexing the diaphragm slightly upwards.

Starting in the illustrated rest position of the pump, when the driving chamber 14 is pressurised by supplying pressure gas through the inlet 22, the diaphragm 10 is flexed downwards to pump liquid from the pumping chamber 12, from where it can escape only through the outlet 20. The gas pressure also acts on the underside of the closure element 28, the area of action being increased by the reduced diameter neck 34 of the member 30, so the closure element 28, is initially held more firmly in the sealing position against the seating 26.

As the diaphragm 10 continues to flex downwards due to the gas pressure, the tension in the stem 32 and neck 34 increases and the annular portion of the closure element 28 between the neck 34 and the valve seating 26 is flexed downwards. The deforming forces in the member 26 continue to increase with the deflection of the diaphragm, storing energy in the member 30 until the downward force on the closure element 28 is sufficient to begin to move it away from the seating 26. Gas can now escape through the outlet passage 24 and the pressure in the driving chamber then falls, although gas continues to be supplied through the inlet 22, because the inlet has a restriction 48 which limits the rate of replenishment of the gas in the chamber.

With the drop of gas pressure, the energy stored in the deformation of the stem, and closure element of the flexible member 30 is released. As a result, the closure element moves sharply away from the outlet passage 24 to release the gas pressure in the chamber 14 completely while the diaphragm begins to return to the illustrated position, so drawing further liquid into the pumping chamber 12. It may be noted that this snap action opening can be used to increase the rate of operation of the pump since the release of pressure from the driving chamber will be less sensitive to the rate at which pressure gas flows into the chamber.

The return of the diaphragm allows the outlet valve to close again, assisted by the tension in the tail 36. The continuing supply of pressure gas to the driving chamber 14 now causes the pressure to build up again in the chamber for the next cycle of operation.

The relatively small cross-section of the tail 36 ensures that the tension force it applies is small in comparison with the release forces acting to open the valve and so the presence of the tail does not impose significant restraint on the opening of the valve. However, the tension in the tail 36 does ensure that the closure element 28 is held centrally with respect to its seating 26 and is always drawn centrally towards that seating when the release forces are dissipated. In this way, each time the gas pressure on the diaphragm 10 is released it is ensured that the valve returns to a fully closed position so that the full driving stroke of the diaphragm is made in the following movement and gas escapes from the driving chamber only when the rapid opening action of the closure element has begun.

The illustrated pump is intended to provide a supply of sterile water under pressure for use in surgical procedures. It is known to provide sterile water in sealed bags which are pierced by a tubular stabbing connecting to give access to the water and the pump may have a suitable connector fixed to the inlet 16 for this purpose. When so used the pump hangs with the inlet uppermost and the position of the outlet 20, close to the top of the pumping chamber then ensures that the pump will be self-priming at start-up.

I claim:

1. A pressure operated pump comprising a pumping chamber having an inlet opening and an outlet opening for the fluid to be pumped, and a fluid pressure driving chamber, a flexible diaphragm between said pumping and driving chambers being displaceable by fluid pressure in the driving chamber to drive fluid through the pumping chamber between said inlet and outlet openings, the driving chamber having an inlet for the supply of pressure fluid thereto and an outlet for release of the pressure fluid, a valve element for closing said driving chamber outlet comprising a resiliently deformable member connected by a connection means to the diaphragm, and an extensible tension element having a first connection with said valve element and a second connection with a fixed location in said pump, said second connection being spaced from said first connection, said tension element urging the valve element to a position closing said driving chamber outlet, said displacement of the diaphragm being directed towards and away from said driving chamber outlet, and the diaphragm displacement away from said driving chamber outlet extending said tension element and thereby moving the valve element away from said driving chamber outlet.

2. A pump according to claim 1, wherein the tension element is integrally formed with the valve element.

3. A pump according to claim 1, wherein the diaphragm, valve element and tension element are integral parts of a resiliently flexible member.

4. A pump according to claim 1, wherein the valve element is in the form of a disc arranged to be flexed in response to the displacement of the diaphragm before opening said driving chamber outlet.

5. A pump according to claim 1, wherein the tension element extends coaxially from the valve element into said driving chamber outlet and anchoring means provided in said driving chamber outlet retain the tension element therein and in a state of tension when the valve element closes said driving chamber outlet.

6. A pump according to claim 1, wherein the connection means between the diaphragm and the valve element is maintained in tension by said tension element, regardless of the pressure in the driving chamber.

7. A pump according to claim 2, wherein the diaphragm, valve element and tension element are integral parts of a resiliently flexible member.

8. A pump according to claim 2, wherein the connection means between the diaphragm and the valve element comprises an integral stem having a reduced cross-section at its junction with the valve element.

9. A pump according to claim 3, wherein the connection means between the diaphragm and the valve element comprises an integral stem having a reduced cross-section at its junction with the valve element.

10. A pump according to claim 2, wherein the valve element is in the form of a disc arranged to be flexed in response to the displacement of the diaphragm before opening said driving chamber outlet.

11. A pump according to claim 3, wherein the valve element is in the form of a disc arranged to be flexed in response to the displacement of the diaphragm before opening said driving chamber outlet.

12. A pump according to claim 2, wherein the tension element extends coaxially from the valve element into said driving chamber outlet and anchoring means are provided in said driving chamber outlet to retain the tension element therein and in a state of tension when the valve element closes said driving chamber outlet.

13. A pump according to claim 3, wherein the tension element extends coaxially from the valve element into said driving chamber outlet and anchoring means are provided in said driving chamber outlet to retain the tension element therein and in a state of tension when the valve element closes said driving chamber outlet.

14. A pump according to claim 4, wherein the tension element extends coaxially from the valve element into said driving chamber outlet and anchoring means are provided in said driving chamber outlet to retain the tension element therein and in a state of tension when the valve element closes said driving chamber outlet.

15. A pressure operated pump comprising a pumping chamber having an inlet opening and an outlet opening for the fluid to be pumped and a fluid pressure driving chamber, a flexible diaphragm between said chambers displaceable by fluid pressure in the driving chamber to drive fluid from the pumping chamber, the driving chamber having an outlet for release of said fluid pressure, the diaphragm being connected to a resiliently deformable member that comprises a valve element for closing said driving chamber outlet, an extensible tension element being connected by a connection means to said valve element to urge the valve element to its position closing said driving chamber outlet, the connection means between the diaphragm and the valve element comprising a stem integral with said diaphragm and valve element and having a reduced cross-section at its junction with the valve element, and the valve element being displaceable through the displacement of the diaphragm against the force of the tension element to open said driving chamber outlet.

16. A pump according to claim 15, wherein the valve element is in the form of a disc arranged to be flexed in response to the displacement of the diaphragm before opening said driving chamber outlet.

17. A pump according to claim 15, wherein the diaphragm, valve element and tension element are integral parts of a resiliently flexible member.

18. A pressure operated pump comprising a pumping chamber having an inlet opening and an outlet opening for the fluid to be pumped and a fluid pressure driving chamber, a flexible diaphragm between said chambers displaceable by fluid pressure in the driving chamber to drive fluid from the pumping chamber, the driving chamber having an outlet for release of the pressure fluid, the diaphragm being connected to a resiliently deformable member that comprises a valve element for closing said driving chamber outlet, an extensible tension element being connected to said valve element to urge the valve element to its position closing said driving chamber outlet, the tension element extending coaxially from the valve element into said driving chamber outlet, and anchoring means comprising a collar fixed in said driving chamber outlet and engaging an increased cross-section portion of said tension element, said anchoring means retaining the tension element therein and in a state of tension when the valve element closes said driving chamber outlet, the valve element being displaceable through the displacement of the diaphragm against the force of the tension element to open said driving chamber outlet.

19. A pump according to claim 18, wherein the valve element is in the form of a disc arranged to be flexed in response to the displacement of the diaphragm before opening said driving chamber outlet.

20. A pump according to claim 18, wherein an extension of said tension element continues beyond said increased cross-section portion.

21. A pump according to claim 18 wherein the diaphragm, valve element and tension element are integral parts of a resiliently flexible member.

22. A pressure operated pump comprising a pumping chamber having an inlet opening and an outlet opening for the fluid to be pumped and a fluid pressure driving chamber, a flexible diaphragm between said chambers displaceable by fluid pressure in the driving chamber to drive fluid from the pumping chamber, the driving chamber having an outlet for release of the pressure fluid, the diaphragm being connected by a connection means to a resiliently deformable member that comprises a valve element for closing said driving chamber outlet, said connection means comprising an integral stem having a reduced cross-section at its junction with said valve element, an extensible tension element being connected to said valve element and extending coaxially from the valve closure element into said driving chamber outlet, and anchoring means in said driving chamber outlet for retaining said tension element therein and in a state of tension when the valve element closes said driving chamber outlet, said tension element urging the valve element to a position closing said driving chamber outlet, and the valve element being displaceable through the displacement of the diaphragm against the force of the tension element to open said driving chamber outlet.

23. A pump according to claim 22, wherein the diaphragm, valve element and tension element are integral parts of a resiliently flexible member.

* * * * *